United States Patent [19]

Ladecky

[11] Patent Number: 4,625,805

[45] Date of Patent: Dec. 2, 1986

[54] OIL PRODUCTION INSTALLATION FOR A SUBSEA STATION OF MODULAR DESIGN

[75] Inventor: Vilhelme Ladecky, Port Gentil République du Gabon, France

[73] Assignee: Societe Nationale Elf Aquitaine (Production), Paris, France

[21] Appl. No.: 673,477

[22] Filed: Nov. 19, 1984

[30] Foreign Application Priority Data

Nov. 21, 1983 [FR] France ..... 83 18458

[51] Int. Cl.[4] ..... E21B 7/12

[52] U.S. Cl. ..... 166/341; 166/349; 166/360; 405/203; 405/195; 175/7

[58] Field of Search ..... 405/195, 169, 170, 203; 166/349, 242, 360, 366, 341; 175/7; 52/272, 275, 283, 284, 286, 79.11, 79.13

[56] References Cited

U.S. PATENT DOCUMENTS

| | | | |
|---|---|---|---|
| 3,618,661 | 11/1971 | Peterman | 166/366 |
| 3,946,805 | 3/1976 | Peterman | 166/349 |
| 4,426,173 | 1/1984 | Richart | 405/195 |
| 4,438,817 | 3/1984 | Pokladnik | 166/366 |

*Primary Examiner*—Cornelius J. Husar

*Assistant Examiner*—Kristina I. Hall

*Attorney, Agent, or Firm*—Poms, Smith, Lande & Rose

[57] ABSTRACT

An installation comprising a base frame 1 having four locations 2 for well heads 20 and a manifold frame 10 disposed in overhanging fashion inside the zone defined by frame 1. Frame 10 has four locations 17 for a stacked pair of connecting 30 and monitoring 40 modules, as well as a central location 17' for a central control module 50. Each module is provided with guide members 26, 32, 41, 52, for example sleeves, whose geometry corresponds to that of guide devices 3, 18 placed either on guide bases 2 of the frames 1, 10 or on the underlying module, such as guide columns 18. Each module comprises on its lower face a mechanical connector 16 cooperating with a mandril 12 carried on the upper face of the underlying module. The control of locking of the connector is provided by an internal multiconnector receptacle 24, 34, 43, 57 which each module comprises. In this remote control installation, the production head zone can be separated from the functional module zone and the modules can be stacked in the order of decreasing reliability, so as to provide easy access to the less reliable modules.

19 Claims, 2 Drawing Figures

OIL PRODUCTION INSTALLATION FOR A SUBSEA STATION OF MODULAR DESIGN

The present invention relates to oil production installations placed in sub-sea stations at great depth. Such stations must be positioned maintained and controlled without direct intervention through automatic remote control systems.

In French Pat. No. 2 317 552 in the name of the applicant, such a sub-sea station is described comprising a base frame on which several recoverable unitary assemblies are removably fixed for maintainence and inspection thereof. A single base frame forming a rigid template placed on the sea bed is provided with several locations for receiving modular assemblies and is also adapted for receiving lateral structures which are connected to the base frame for protecting the modular assemblies and the fluid pipe lines carried by them. More precisely, the locations receive through a guide base having four guide columns production blocks in modular form, for example a double module comprises, stacked on the guide columns of the base, equipment for a cluster of well heads formed of a security block, above which is placed a production block carrying automatic and remote control equipment housed in the form of containers in housings formed in the upper face of the casing covering said production block. Such constructions constitute considerable progress, more particularly concerning the possibility of raising to the surface less reliable parts of the installation, but they also have several disadvantages. The production head is encumbered by control equipment housed thereabove, which makes the raising of this head difficult. The containers containing the control equipment are placed eccentrically with respect to the axis of the module, which means that placing same by means of a stringer train is a delicate operation. The production block is stacked on the same guide columns fixed to the base on which the safety block is already fitted, which means, in view of the inevitably reduced length of these columns, supporting the safety block by lateral arms ending in sleeves having a curved shape, for which it is difficult to obtain perfect symmetry. Moreover, the work carried out around well heads often leave traces and separation of these locations from those of the control and monitoring equipment seems desirable.

In accordance with the ideas which guided the authors of the present invention, the well head equipment and the control and monitoring equipment have been strictly separated by grouping this latter equipment on a separate frame, called manifold. Then, to facilitate the different connections between the modules, the modules have been stacked in height in the order of decreasing reliability, namely the connecting and monitoring modules, the central control module of less reliability being disposed separately from the other modules. The method of stacking proposed also avoids an excessive length of the guide columns, by fixing each module to the individual guide columns belonging to the underlying module.

The standardization of the fixing and locking means has been improved to the extent that, for each module such as the well head module, the connecting, monitoring and central control modules, may be lowered, locked and raised by means of a single positioning and connecting manipulator.

The installation of the invention thus comprises an oil production installation of a sub-sea station of modular design having a base frame with, in at least one zone adjacent its sides, one or more locations for modules surrounded by a guide base fixed to the frame and intended to receive a modular production unit provided with a christmas tree, characterized in that another zone of the frame defines an area on which a manifold frame is disposed in overhanging fashion comprising an integral part one or more guide devices for receiving a functional modular unit or several stacked modular units, such as a connecting unit, a peripheral monitoring unit and a central control unit of the station, each modular unit being provided with guide members whose geometry corresponds to that of the guide devices placed either on the guide bases fixed to the frame or on the underlying modules.

All the guide devices fixed to the frame preferably comprise guide columns placed at the four corners of a guide base, each module being coupled directly to said base comprising guide sleeves with spacing corresponding to that of the guide columns.

Each module may advantageously comprise, erected on its upper face on each side of its center, two upper guide columns with identical spacing for all the modules and the modules, other than those which are directly coupled to the guide base, may be provided in the thickness with guide sleeves cooperating with said upper columns of the underlying module.

Each module carries centrally on its lower face a mechanical connector cooperating with a connecting mandril carried by the upper face of the underlying module.

On the top, each module has an internal multiconnector receptacle for controlling the locking of its connector in a module location on a frame or on the underlying module, which are provided with standard sleeves.

In a preferred embodiment, the location of the base frame corresponds to a well head and the modular unit placed on the corresponding guide base is a production head provided with a christmas tree. This production head is provided with an external multiconnector receptacle for joining to the monitoring module, as well as an effluent outlet connector for joining with the connecting module. In this same embodiment, the manifold frame comprises guide bases, in number corresponding to that of the well heads, each receiving a connecting module fixed directly to the base, then, stacked on the connecting module, a peripheral monitoring module covered by an individual shield. The connecting module has a multipassage loop ending in a connector for connection to the effluent outlet connector of the production head.

The monitoring module has an internal multiconnector for joining to the multiconnector receptacle of the connecting module, as well as an external multiconnector receptacle for joining to the central control module and an external multiconnector for joining to the production head.

The manifold frame further comprises a guide base receiving a central control module of the station covered by an individual shield. This module has at least one internal multiconnector for joining to the manifold frame, four external multiconnectors for joining to the monitoring modules and two external multiconnectors for joining with the main and secondary relief umbilicals. On the base frame are fixed the production discharge ducts and the umbilical head, to which the surface ducts and cables are connected for electro-hydraulic control.

Advantageously, the mandrils placed on the upper face of all the modules are adapted for engagement by a mechanical connector of a positioning manipulator having display means and electro-hydraulic control means controlling the locking of the mechanical connectors carried by the manipulator and by each module for interconnection with the underlying module and, possibly, with the lateral modules. The manipulator is further provided with angular positioning means in the form of two guide sleeves cooperating with the upper guide columns erected on the upper face of each module.

Advantageously, the base frame has, in the zone intended for the manifold frame, guide posts for positioning the manifold frame.

Other features of the invention will be clear from the following description given by way of example of a sub-sea production installation.

Figure 1:
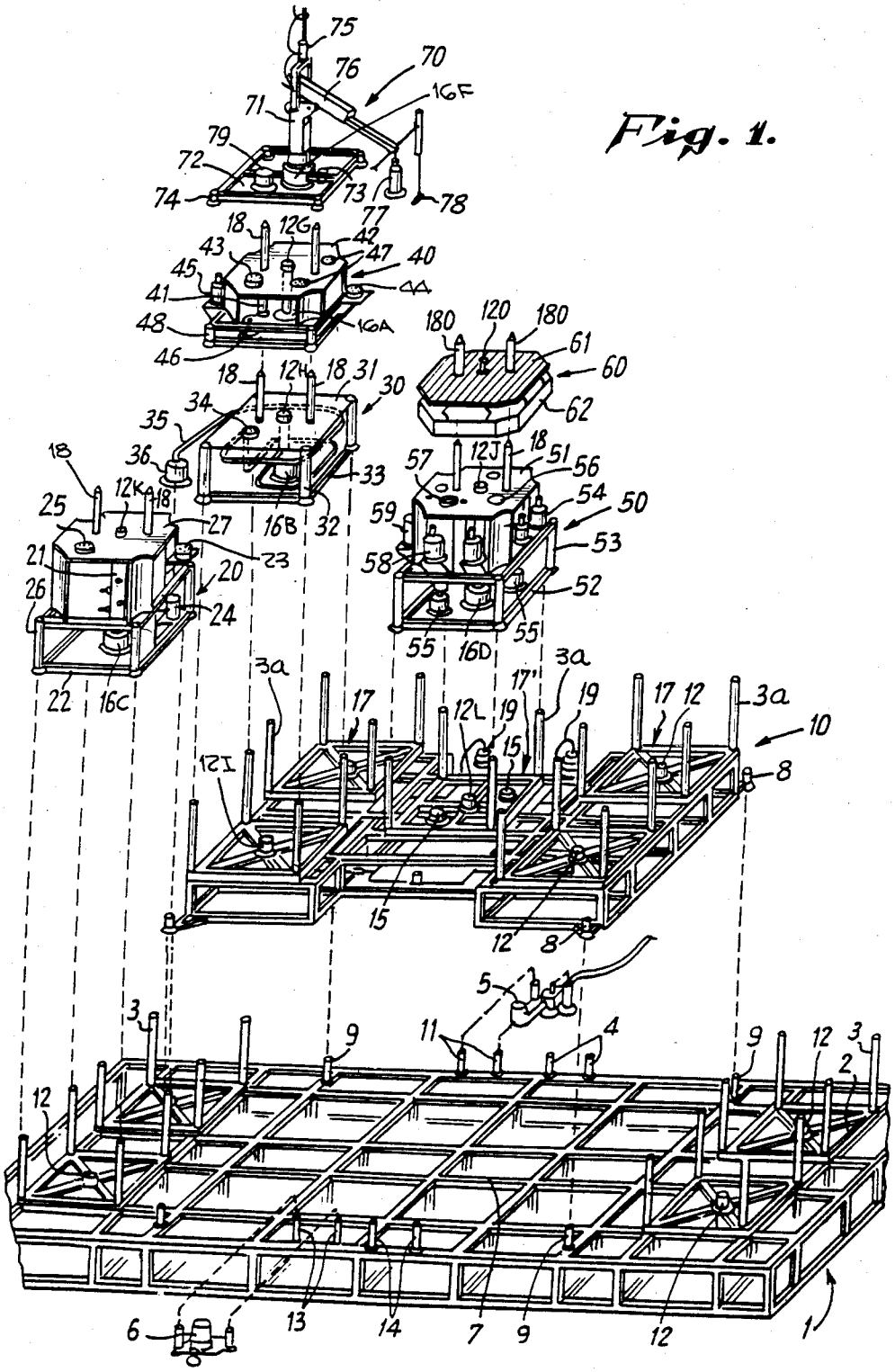
FIG. 1 shows in exploded form, the different arrangements and dispositions of a multi module sub-sea station.
Figure 2:
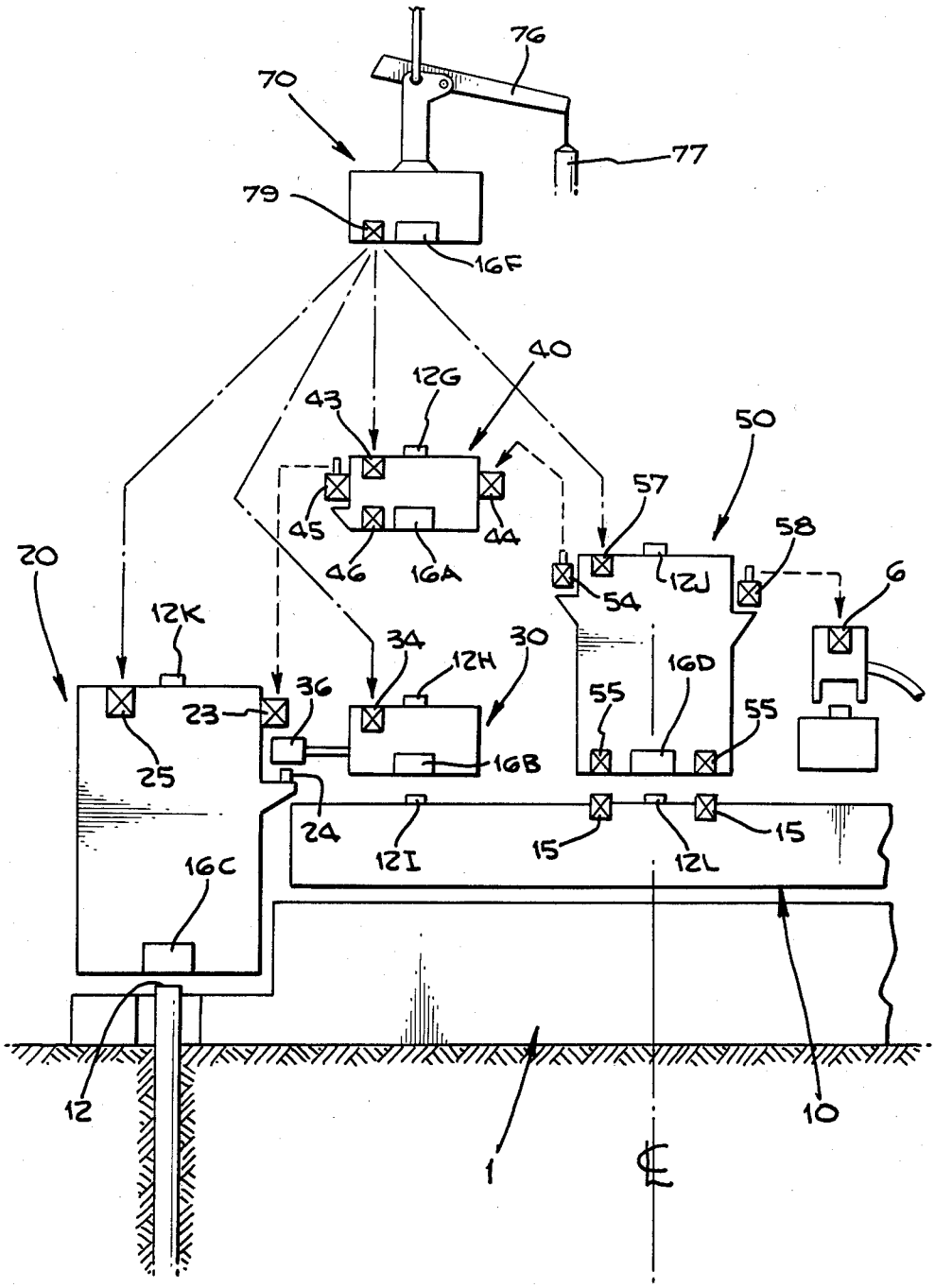
FIG. 2 is a schematic view of the left portion of FIG. 1 illustrating interconnections between multiconnector means for hydraulic and electrical control and mechanical connectors for locking and unlocking of mechanical connectors and receptacles, the right portion not being shown because of similar arrangements of module units.

Reference numeral 1 designates a rectangular base frame, whose structural elements such as side members, cross members and struts are similar to those described in French Pat. No. 2 371 552. Its particular characteristic is to group together on the two short sides of the rectangular four locations, two on each side, for the well heads in the form of receiving apertures, each having as an integral part a guide base 2 having guide columns 3 mounted thereon and in which the diagonal bars support an axial well head mandril 12. The lateral sides of the base frame support production discharge ducts, not shown, by means of guide posts 11 and 4, and injection head 5 and an umbilical head 6, to which are connected the ducts and cables of the surface monitoring and control unit, which may be situated at a few tens of kilometers from the station and/or from the emergency buoy at a few hundred meters from the station, said ducts and cables being guided by means of guide posts 13 and 14.

The central zone 7 remains unoccupied and is intended to receive a manifold frame 10. For this, side members of the base frame 1 are provided with guide posts 9, on which are fitted the sleeves 8 with which the manifold frame 10 is provided. Guide posts 11 and 13 integral with the base frame serve, respectively, for fixing the umbilical head 6 and for guiding the injection head 5. The locations for the well heads are intended to receive, each one, a production head 20 forming a case enclosing the christmas tree 21 and its production and safety equipment between an upper plate 27 comprising centrally the mandril 12, two guide columns 18 placed on each side of the center and an internal multiconnector receptacle 25 and a lower rectangular frame 22 comprising centrally a mechanical connector 16C adapted for gripping and locking the well head mandril 12 of the guide base integral with the base frame 1 (for clarity mechanical multiconnectors and mating receptacles will be identified as with reference numerals 16 and 12 respectively with alphabet letters). At the four corners of frame 22 are disposed guide sleeves 26 sliding on the guide columns 3 of the guide base of the base frame.

The unit also comprises an external multiconnector receptacle 23 for connection to the monitoring module 40 by means of the multiconnector 45, as well as an effluent outlet 24 connected to the connecting module 30 through connector 36.

The rectangular manifold frame 10 formed of side members, cross members and struts, of dimensions corresponding to those of the zone 7 of the base frame 1, has four peripheral locations for connecting modules 30 and a central location for the central control module 50. At each side frame 10 are situated two guide bases 17 for the connecting module 30 and in the center a central guide frame 17' for the central control module 50 having two receptacles 15 for internal electrohydraulic multiconnectors 55.

At the edge of the manifold frame 10 are fixed two connectors 19 intended to be connected to the base of injection head 5 positioned by guidepost 11 on base frame 1. The number of mechanical connectors 16 corresponds to the number of well heads. Bases 17 and 17' may form an integral part of the manifold frame 10 or be added thereto. Construction thereof is identical to that of the guide bases forming part of the base frame and similar to that of the guide bases described in the above mentioned patent. Their square frames comprise diagonally disposed struts which support in the axis a mandril 12I (base 17, a mandril 12L base 17') adapted to be gripped and locked by a connector, 16B (base 17), 16D (base 17') which will be described further on.

Four guide columns 3 of a length which is not excessive are erected at the four corners of the square of the guide base 2.

Each base 17 is intended to receive a connecting module 30 (only one being shown) which is in the form of a square casing comprising a top plate 31 connected at the four corners by guide sleeves 32 to a frame of constructional sections 33. In the axis of the module are fixed, on the top of the plate 31, an internal multiconnector receptacle 34 and a mandril 12H and on the bottom of the case a mechanical connector 16B adapted for gripping and locking the mandril 12L of the manifold frame 10.

Inside there is provided a multipassage flexible loop 35 ending in a connector 36 for connection to the effluent and monitoring outputs 24 of the christmas tree. On the upper plate 31 two guide columns 18 are placed on each side of its center.

Hydraulic circuits ensuring operation of the mechanical connector 16B and of other hydraulic circuits intended to be connected to the connector 24 of the production head 20, more particularly the connection of the connecting module 30 to the output mandril 12 of the well head, complete the equipment of this module 30.

The purpose of guide columns 18 is to position a monitoring module 40 by means of sleeves 41 housed in the thickness of the module, which is in the form of a casing on which is fitted a plate 42, to which are fixed, as in the case of module 30, two guide columns 18 and a mandril 12 as well as the female part 43 of the internal multiconnector. On the edges of the module are placed, respectively, an external multiconnector 45 for connection with the christmas tree 21 through receptacle 23 and an external multiconnector receptacle 44 for connection with the central control module 50 (multiconnector 54).

Electronic and electro-hydraulic containers 47 complete the equipment of the monitoring module 40.

The lower frame to which the upper plate 42 is fixed by metal sheet and extruded sections, is provided at the four corners with guide funnels 48 which participate in guiding the module 40 by means of guide lines (not shown) fastened to columns 3 of the guide base. The bottom of the module 40 is also provided with a mechanical connector 16A for joining with the connecting module 30 and the male part 46 of a multiconnector for the functional electric and hydraulic monitoring of the module 30, such as pressure sensors, adjustable nozzle for regularizing the flow rate and control thereof, sand presence detector, hydraulic interconnection valves and others.

The central guide base 17' of the manifold frame 10 is intended to receive a central control unit 50, whose case is formed by an upper plate 51 supported above a lower rectangular frame 52 having at its four corners guide sleeves 53 for sliding on the columns 3 of the manifold frame 10.

On the module 50 are further placed four external electro-hydraulic multiconnectors 54 for joining to the receptacle 44 of the monitoring module 40, one or two internal electro-hydraulic multiconnectors 55 connecting this unit to the female part of the multiconnectors 15 integral with the manifold frame 10, at the base 17' and other external mobile male multiconnectors 59 connecting the module 50, respectively, to each monitoring module 40 and external multiconnecstors 58.

The inside of the module 50 contains containers 56 for the hydraulic, electric, electronic and electro-hydraulic equipment. Each location waiting for the positioning of a module and each module intended to remain, temporarily or definitely, uncovered by another module, after final positioning thereof, is protected by a shield of modular design 60. Its construction may be used as described in U.S. Ser. No. 624,625 filed June 26, 1984 owned by a common assignee. It is a plate 61 serving for absorbing the energy of shocks, integral with a skirt 62 serving as gas trap. It has two guide tubes 180 of an inner diameter such as to be able to receive the guide columns 18 and, in the axis, a mandril 120 adapted for the passage of hydraulic fluid on its upper plate 61, and a mechanical connector such as 16 at its lower part (not shown).

In the case shown, shield 60 is intended to be positioned on the central control unit 50, but shields of the same design and so interchangeable may protect the module 20 representing the well head, as well as the connecting module 30 and the monitoring module 40 or even an unused location of the manifold 10.

The operations for positioning and connecting the pipes were, in the prior art, assisted by a robot supported by and travelling over wheels of the lateral structures of the single base frame, see Pat. No. 2 371 552. In the new conception, such a robot is advantageously replaced by a suitably equipped connecting and positioning manipulator 70. It is in the form of a crane mast 71 placed axially on a base plate or structure 72 comprising, on the one hand, two guide tubes 73 for guiding the columns 18 and situated on each side of the center of the plate and, on the other, four guide funnels 74 placed at the corners of the plate for sliding down the guide lines fastened to the guide columns 3 of the frame 1. A junction 75 at the top of the mast for a stringer train allows it to be lowered from a floating structure. An internal multiconnector 79 serves for transmitting the electro-hydraulic commands through a bundle of surface cables and ducts to the module carried by the manipulator. On the bottom of the plate is placed axially a mechanical connector 16F intended to grip mandril 12G, 12H, 12I, 12J, 12K, 12L of a standardized design, present on any of the previously mentioned modules. On the mast is pivotably mounted a telescopic crane 76 comprising a bell for handling and activating the multiconnectors in the form of handling tool 77 with display means 78. The handling tool may be of the known kind with electro-hydraulic controls for moving, locking and unlocking the numerous external multiconnectors present on the above described functional modules. A positioning and connecting manipulator particularly well adapted for operation in the conditions of a sub-sea modular station forming the subject of the present application is described in detail in a copending U.S. application, Ser. No. 672,944 filed Nov. 19, 1984, owned by a common assignee.

The installation of a sub-sea station in accordance with the invention is achieved in the following way. The base plate 1 provided with guide bases is positioned on a sea bed by means of lowering equipment and it is levelled with the help of appropriate mechanisms. After drilling the four wells, the production heads 20 and their shields similar to shields 60 are installed, the manifold frame 10 is lowered and positioned in zone 7 which is reserved for it in the center of the base plate, using guide posts 9 on which the guide sleeves 8 are engaged.

Lowering of the module representing the production head 20 may be achieved by means of the manipulator 70 which, locked by means of connector 16F on mandril 12K of the module 20 and positioned angularly by means of columns 18 fitting into the guide tubes 73 of the manipulator, is lowered from the boat by means of a stringer train along guide lines attached to columns 3 on base frame 1. Using the display means 78 carried by the manipulator, the module lowered to the vicinity of the chosen location on the base frame 1 is positioned angularly so that the four guide sleeves 26 of the module 20 are fitted on the four columns 3 of the base frame 1. Whilst in position, the module 20 is locked to the base frame 1 by means of the handling tools 77 which provides locking of the mechanical connector 16F of the module 20 on mandril 12 of the base frame 1 and the functional operations of the module 20. After positioning of the module, the mechanical connection between the manipulator and the module is released by means of tools 77 and the manipulator is again available for other tasks.

Umbilical head 6, with which all the electro-hydraulic connections of the umbilical head 6 duct are engaged, is lowered by means of a known device and locked in the location provided at the edge of the base frame 1, by means of mandrils 13 and guide posts 13 of the frame cooperating with the guide tubes of the umbilical head 6. The umbilical line is then laid on the sea bed as far as the surface control unit, which may be situated at several tens of kilometers and/or as far as the buoy anchored at a few hundred meters from the station.

The four connecting modules 30 are lowered and fixed to the guide bases in a similar fashion. Above each module 30 is then placed a monitoring module 40. Guiding in the final approach is provided by columns 18 which must penetrate into the sleeves 41 formed inside modules 40. During this operation, the male multiconnector 46 is connected to the female multiconnector 34 of the connecting module 30.

Consequently, the central unit 50 is lowered in the same way to the corresponding location on the manifold frame 10.

As has already been mentioned, manipulator 70 effects the electro-hydraulic connections between the different modules, thus, it moves the multiconnectors and provides the connections between:

central control module 50 and the umbilical head 6 (connector 58 to umbilical head 6)

the central control module 50 and the monitoring modules 40 (connectors 54 to connectors 44)

the connecting module 30 and the well head unit 20 (connector 36 to connectors 24)

the monitoring unit 40 and the production head 20 (connector 45 to connector 23)

the manifold ducts and the production ducts (connector 19 to injection head 5).

In more detailed explanation of the above, the mechanical connector 16F of the manipulator 70 when activated hydraulically allows the locking and unlocking of the manipulator respectively with mandrils 12G (module 40), 12H (module 30), 12I (manifold 10), 12J (module 50), and 12K (production head 20). Such locking and unlocking operations are controlled by the male part of the multi connector 79 carried by the manipulator 70 and adapted to be activated from the surface when the male part is interconnected with the receptacles respectively 43 (module 40), 34 (module 30), 57 (module 50) and 25 (production head 20).

Further, when the multiconnector 79 is in liason with receptacle 25, it locks and unlocks the mechanical liason between 16C and 12K and opens the valves of the production head 20 communicating with a riser or an annulus of the well head.

When the multiconnector 79 is in liason with 43, it locks and unlocks the mechanical liason between 16A (module 40) and mandril 12H (module 30) and performs the liason between the male part 46 of the multiconnector (module 40) on the receptacle 34 (module 30) for electrical control.

When the multiconnector 79 is in liason with 34, it locks and unlocks the mechanical connection between 16B (module 30) on 12I (manifold 10) and the liason between affluent conduits 36 (module 30) and 24 (production head 20), as well as other functions such as activation of testing valves, cross-over valves, leading off, pressure measures, etc.

When the multiconnector 79 is in liason with 57, it performs the locking and unlocking of 16D (module 50) on 12L (manifold 10) and of 55 (module 50) with 15 (manifold 10) for electrical control.

The tool 77 of manipulator 70 provides for the transfer and the making of electrical and hydraulic connections between connectors 45 and 23, connectors 54 and 44, connectors 58 and the umbilical head 6. The connection of multiconnector 55 to receptacle 15 supplies electrical and hydraulic circuits for actuation of valves of the manifold 10 as for isolating the module 30 and for controlling production flow, etc.

The connection of the multiconnector 45 with the receptacle 23 concerns the hydraulic circuits for activation of valves of the production head 20 and security valves and of electrical circuits providing information about the state and condition of the valves, the pollution, etc.

The connection between connector 54 and receptacle 44 of the modules 50, 40 supplies module 40 with hydraulic energy generated and stocked on module 50, supplies to the module 40 the electrical energy and allows both directional transfer of multiplexed signals about the state of the valves, the resulting measures and for control of operation for module 30 and from production head 20.

The connection of the connector 46 with 34 (modules 40 and 30) provides for the activation and control of module 30.

The connections of the connector 58 and 59 with the umbilical head 6 allows the connection of an umbilical line, sometimes 20 kilometers long, directly to the control unit 50 for supply of energy and information. Umbilical head 6 is connected to the template or base frame 1.

The intermodular connections between the modules of the manifold and the modules integral with the base plate are provided by connections allowing a relative positioning tolerance. As for the connections internal to the modules resting on the manifold, the proximity of the parts to be connected is such that less flexible materials with less deflexion may be used for the connections, for example between the central control module 40 and the internal valve controls of the manifold.

The advantages of such a modular design of a sub-sea station are important. No production monitoring equipment is placed above the production head 20. On the other hand, such equipment is placed part on the connection module 30 (adjustable nozzle with unquestionable wear) and in part on the monitoring module 40 (electro-hydraulic distributor to the connecting module 30 and the production head 20 after decoding of the orders).

Thus, all the less reliable modules are situated above, so that access thereto and handling thereof are facilitated, and outside the production head 20. Each less reliable module may be raised directly, using the positioning and connecting manipulator 70, which automatically releases all the interconnections through the action of its tool 77. The lifting and lowering operations carried out with the help of the manipulator are executed with axial application of the force on each module through the mandril 12 and connector 16 system placed axially on each module.

I claim:

1. An oil production installation for a subsea station of modular design comprising a base frame (1) having in at least one zone one or more locations for modules, guide bases (2) having guide members (3) in said one zone fixed to the frame and intended to receive a modular production unit (20) including a christmas tree (21), comprising, in combination:

said base frame having at least a second zone;

a manifold frame (10) at said second zone, said manifold frame having one or more guide bases (17), (17') having guide members **(3*a*)** adapted to receive one or more functional modular units;

one or more modular units (30, 40, 50) having guide sleeve members adapted to cooperate with said guide members **(3*a*)**;

each guide base (17) (17') and each unit (30, 40, 50) having a mandril (12);

each modular unit having a mechanical connector (16) for mating with a mandril (12) to allow locking and unlocking of a modular unit with its associated guide base or with modular unit;

each modular unit having upstanding internal guide columns (18) at the top thereof;

each modular unit including guide sleeves for reception of said guide column (18) of a modular unit adapted to be vertically stacked thereon;

whereby production control units (20) are separate from units stacked thereon and whereby said manifold frame (10) may support modular units in said second zone in selected stacked relation in which units requiring more frequent service are located on top.

2. An installation as claimed in claim 1 wherein each modular unit includes an internal multiconnector receptacle (25, 34, 43, 57) for controlling locking of its mechanical connector (16) when the module unit is located on a guide base (17, 17') or over an underlying modular unit.

3. An installation as claimed in claim 1 including an external multiconnector receptacle (23) on said production unit;

one of said modular units being a monitoring module (40);

and an external multiconnector (45) on said monitoring module (40) for connection to said multiconnector receptacle (23).

4. An installation as claimed in claim 1 including an effluent outlet connector (24) on said production unit (20);

a connecting modular unit (30) positioned on said manifold frame and having a connector (36) for joining to the outlet connector (24) on the production unit (20).

5. An installation as claimed in claim 1 wherein said guide bases (17) on the manifold frame (10) correspond in number to that of the well heads therebeneath, a connecting module (30) received by said guide base (17);

a peripheral monitoring modular unit (40) stacked on said connecting modular unit (30);

and a modular unit shield (60) covering said monitoring module (40).

6. An installation as claimed in claim 5 wherein:

said connecting modular unit (30) includes a multipassage loop (35), and a connector (36) at the end of said loop for connection to an effluent outlet connector (24) of production head (20).

7. An installation as claimed in claim 6 including an internal multiconnector (46) provided on said monitoring module (40);

a central control modular unit (50);

a multiconnector receptacle (34) on the connecting modular unit (30) for joining the multiconnector (46) to the central control modular unit (50);

said monitoring modular unit (40) having an external multiconnector (45) for joining to the production head (20).

8. An installation as claimed in claim 5 including an additional guide base (17') provided on said manifold frame (10);

a central control modular unit (50) received on said guide base (17');

and a shield (60) covering the control modular unit (50).

9. An installation as claimed in claim 8 wherein:

said central control modular unit (50) includes at least one internal multiconnector (55) for connection to manifold frame (10);

and four external multiconnectors for connection to monitoring modular unit (40);

and two external multiconnectors (58) adapted for connection to main and secondary umbilical lines.

10. An installation as claimed in claim 1 including an injection head (5) and an umbilical head (6) connected to base frame (1) for transmission to the installation of electro-hydraulic controls.

11. An installation as claimed in claim 1 wherein:

said mandrils (12) are located on an upper plate of each of the modular units;

a positioning and connecting manipulator (70) including display means (78);

said manipulator (70) having a mechanical connector for selective engagement with said mandrils (12).

12. An installation as claimed in claim 11 wherein:

said manipulator (70) includes a pair of guide sleeves (73) adapted to cooperate with guide columns (18) provided on the upper plate of each modular unit for angular positioning means.

13. An installation as claimed in claim 11 including electro-hydraulic means on said positioning manipulator (70), said electro-hydraulic means providing control of locking of mechanical connectors (12) and (16) carried by the manipulator and by each modular unit for interlocking with an underlying module and an lateral module.

14. In a subsea installation including a template base frame for a plurality of wells and having means on said frame for positioning and locating a plurality of guide bases (2, 17, 17'), the combination of:

each of said guide bases having a centrally located mechanical connector (12);

means for mounting a plurality of production units (20) on certain of said guide bases (2);

means for mounting a plurality of functional module units on other of said guide bases (17, 17');

said functional module units each including a centrally located mechanical connector (16) for locking and unlocking engagement with said mechanical connector (12) on said guide base or on a vertically adjacent module unit;

means on each module unit for angular orientation with a vertically adjacent module unit;

and multiconnector means on each of said units for hydraulic and electrical control of installation operations;

said vertically adjacent module units being stacked vertically in order of reliability and expected maintenance.

15. An installation as claimed in claim 14 wherein:

one of said functional module units includes a control module unit (50).

16. An installation as claimed in claim 14 wherein one of said functional module units includes a connecting unit (30).

17. An installation as claimed in claim 14 wherein one of said functional module units includes a monitoring unit (40) adapted to be vertically stacked over said connecting module unit (30).

18. An installation as claimed in claim 14 including a shield unit (60) cooperable with said angular orientation means on one of said module units for protecting said unit.

19. An installation as claimed in claim 14 including a manipulator unit (70) having a mechanical connector (16) for cooperation with a mechanical connector (12) of one of said functional module units.

* * * * *